US007079786B2

(12) United States Patent
Tanaka

(10) Patent No.: US 7,079,786 B2
(45) Date of Patent: Jul. 18, 2006

(54) IMAGE FORMING APPARATUS

(75) Inventor: Kenji Tanaka, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/991,494

(22) Filed: Nov. 19, 2004

(65) Prior Publication Data

US 2005/0111875 A1 May 26, 2005

(30) Foreign Application Priority Data

Nov. 21, 2003 (JP) ..... 2003-393059

(51) Int. Cl.
*G03G 15/02* (2006.01)

(52) U.S. Cl. ..... 399/100; 399/99; 399/101; 399/115; 399/170; 399/172

(58) Field of Classification Search ..... 399/100, 399/101, 99, 170, 172, 115

See application file for complete search history.

(56) References Cited

U.S. PATENT DOCUMENTS

| | | | | |
|---|---|---|---|---|
| 3,953,772 | A * | 4/1976 | Zimmer | 399/100 |
| 4,073,587 | A * | 2/1978 | Selwyn | 399/100 |
| 4,516,848 | A * | 5/1985 | Moriya | 399/100 |
| 4,680,669 | A * | 7/1987 | Tsuchiya et al. | 399/98 |
| 5,181,069 | A * | 1/1993 | Oleksinski et al. | 399/115 |
| 5,557,373 | A * | 9/1996 | Miyashita et al. | 399/9 |
| 5,761,578 | A * | 6/1998 | Cousoulis et al. | 399/100 |
| 6,909,867 | B1 * | 6/2005 | Mishra et al. | 399/173 |

FOREIGN PATENT DOCUMENTS

| | | |
|---|---|---|
| JP | 5-107867 A | 4/1993 |
| JP | 2000-058224 A | 2/2000 |
| JP | 2000-242060 A | 9/2000 |
| JP | 2002-123068 A | 4/2002 |

* cited by examiner

*Primary Examiner*—Arthur T. Grimley
*Assistant Examiner*—Crystal Wagner
(74) *Attorney, Agent, or Firm*—Foley & Lardner LLP

(57) ABSTRACT

In an image forming apparatus according to the present invention, the force of a tension spring returning to its original position is utilized to vibrate or impact a conductive member using a predetermined timing, one end of the conductive member being fixed and the other end of the conductive member being connected to a knob via a tension spring. This serves to remove attachments adhering to the tips of the conductive member.

8 Claims, 8 Drawing Sheets

IMAGE FORMING APPARATUS

CROSS-REFERENCE TO RELATED APPLICATIONS

This application is based upon and claims the benefit of priority from prior Japanese Patent Application No. 2003-393059, filed Nov. 21, 2003, the entire contents of which are incorporated herein by reference.

BACKGROUND OF THE INVENTION

1. Field of the Invention

The present invention relates to, for example, an image forming apparatus comprising an image reading device that obtains image data from a copy target.

2. Description of the Related Art

An image forming apparatus comprises a photosensitive member on which an electrostatic image and a developer image are formed and a charging device that charges the photosensitive member to a predetermined potential.

Known charging devices use a wire-, brush-, or needle-like electrode.

For example, Jpn. Pat. Appln. KOKAI Publication No. 2000-242060 (Abstract, claim 1, FIG. 1, paragraphs [0024], [0025], and others) discloses a technique employing a charging device having a wire-like electrode. With this technique, a piezoelectric transformer is connected to the wire-like electrode so as to supply a high-voltage to the wire-like electrode. Then, the wire is prevented from being contaminated by transmitting to the wire a mechanical vibration which generated when the piezoelectric transformer is driven.

Further, Jpn. Pat. Appln. KOKAI Publication No. 2002-123068 (Abstract, claim 1, FIG. 1, paragraphs [0006], [0007], and others) discloses a technique employing a charging device having a brush-roller-like electrode. With this technique, vibration is generated in an axial direction to cause attachments adhering to an outer peripheral surface of the brush roller to float. Then, sucking means is used to collect the attachments.

Moreover, Jpn. Pat. Appln. KOKAI Publication No. 5-107867 (Abstract, claim 1, FIG. 1, paragraphs [0024], [0025], and others) discloses a technique also employing a charging device having a brush-roller-like electrode. With this technique, vibration is generated in the axial direction to prevent non-contact between the brush roller and a photosensitive drum in the axial direction. The photosensitive drum is thus charged to a uniform potential.

Furthermore, Jpn. Pat. Appln. KOKAI Publication No. 2000-58224 (Abstract, claim 1, FIG. 3, and others) discloses a technique employing a charging device having a saw-tooth-like electrode. With this technique, a cleaning member is abutted against the saw-tooth-like electrode. The cleaning member then moves parallel to the electrode to remove contamination from the electrode.

As described above, when attachments adhere to a charging device charging a photosensitive member, disadvantageously the entire photosensitive member is not uniformly charged. In particular, if a needle-like electrode such as the one shown in Patent Document 4 is used, when a developer or attachment such as dust which floats through a main body adheres to the needle-like electrode, an insufficient discharge may occur in the adhering parts. Thus, a nonuniform discharge may occur on the surface of the photosensitive member; that is, a nonuniform potential may be formed in the axial direction. This may prevent a satisfactory image from being formed.

Further, with the technique disclosed in Patent Document 4, the cleaning member is brought into contact with the needle of the electrode. Consequently, the needle may be bent by the cleaning member caught at the tip of the needle. On this occasion, the bent needle cannot cause a sufficient discharge, resulting in a nonuniform discharge from the surface of the photosensitive member. This may prevent a satisfactory image from being formed.

BRIEF SUMMARY OF THE INVENTION

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

With reference to the drawings, description will be given of an example of an image forming apparatus according to the present invention.

Figure 1:
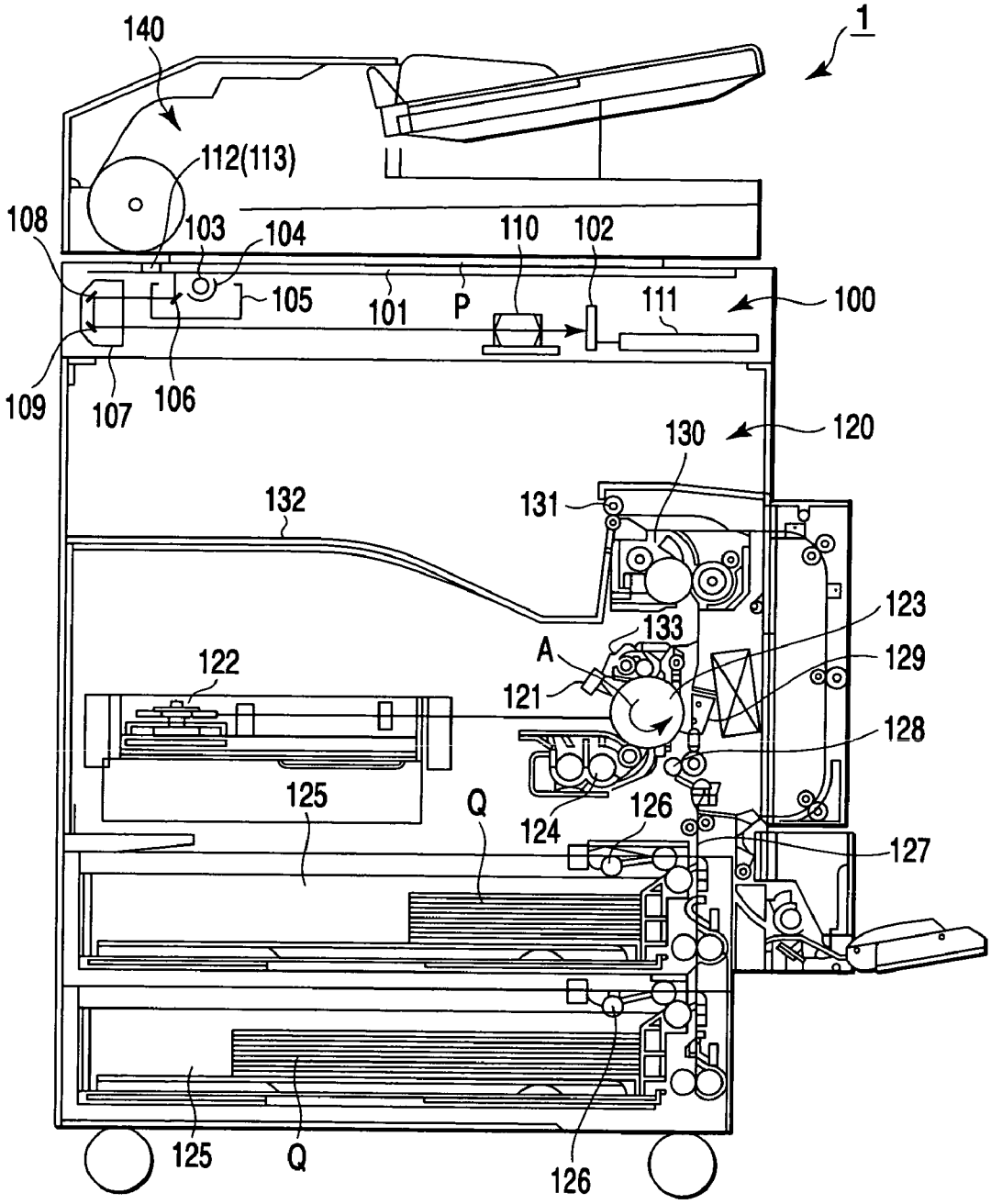
FIG. 1 is a schematic diagram illustrating an example of an image forming apparatus according to the present invention.

As shown in FIG. 1, an image forming apparatus 1 comprises a scanner (image reading device) 100 that reads an image from a read target (copy target) to generate a first image signal, and an image forming section 120 that forms an image on the basis of a second image signal. The scanner 100 may be provided with an automatic document feeding device (ADF) 140.

The scanner 100 comprises a document table 101, an illuminating lamp 103, a reflector 104, a first carriage 105, a first mirror 106, a second carriage 107, a second mirror 108, a third mirror 109, a lens 110, a photoelectric converting element (CCD sensor) 102, and an image processing section 111.

The document table 101 consists of a light-transmissive material and holds a copy target (document) P that is a three-dimensional object such as a book or a sheet-like document.

The illuminating lamp 103 irradiates the document table 101 with light from below.

The reflector 104 condenses and directs light emitted by the illuminating lamp 103 to a predetermined position on the document table 101.

The illuminating lamp 103 and the reflector 104 are fixed to the first carriage 105. The first carriage 105 reciprocates along a surface of the document table 101.

The first mirror 106 guides a reflected light from the document P illuminated by an illumination light from the illuminating lamp 103 and reflector 104, that is, image information from the document P, in a predetermined direction (to the second carriage 107). For description, the reflected light from the document will hereinafter be referred to as image light.

The second carriage 107 holds and moves the second mirror 108 and third mirror 109 along the surface of the document table 101 in unison with the first carriage 105.

The second mirror 108 bends image light reflected by the first mirror 106 through 90° and then guides the bent light to the third mirror 109.

The third mirror 109 bends the image light reflected by the second mirror 108 through 90° and then guides the bent light to the lens 110.

The lens 110 provides the guided image light with a predetermined image formation magnification. The lens 110 forms an image on the CCD sensor 102, placed at a focal position of the lens 110.

The CCD sensor 102 converts the image information (image light) from the document P into an electric signal. The CCD sensor 102 then outputs a first image signal.

The image processing section 111 executes a predetermined image process on the first image signal outputted by the CCD sensor 102. The image processing section 111 outputs image information as a second image signal.

The image forming section 120 comprises a charging device 121, an exposure device 122, a photosensitive drum 123, a developing device 124, a sheet cassette 125, a pickup roller 126, a conveying path 127, an aligning roller 128, a transfer device 129, a fixing device 130, a paper discharging roller 131, a tray 132, and a cleaning mechanism 133.

The charging device 121 causes a discharge at a predetermined discharge position to supply predetermined charges to an outer peripheral surface of the photosensitive drum 123.

The exposure device 122 outputs a laser beam having a light intensity varied on the basis of a second image signal output by the image processing section 111. The laser beam is incident on the outer peripheral surface of the photosensitive drum 123 charged by the charging device 121 to a uniform potential in an axial direction.

The photosensitive drum 123 is irradiated with a laser beam and holds an electrostatic image, that is, an electrostatic latent image, corresponding to the image from the document P.

The developing device 124 provides a developer (for example, a toner) to the photosensitive drum 123 rotating in the direction of an arrow A. The electrostatic latent image (not shown) is converted into a toner image.

The sheet cassette 125 accommodates paper Q.

The pickup roller 126 takes the paper Q out of the sheet cassette 125 sheet by sheet to guide it to the conveying path 127.

The conveying path 127 has a plurality of rollers to guide the paper Q to the photosensitive drum 123.

The aligning roller 128 stops the paper Q guided through the conveying path 127 in order to align the toner image (not shown) with a position on the paper Q to which the toner image is to be transferred. The aligning roller 128 then conveys the paper Q to the photosensitive member 123 at a predetermined time.

The transfer device 129 electrostatically transfers the toner image to the paper Q at a transfer position opposite the photosensitive drum 123, that is, at a predetermined downstream position in a direction in which the developing device 124 is rotated.

The fixing device 130 secures or fixes the toner image (not shown) transferred to the paper Q, to the paper Q.

The paper discharging roller 131 discharges the paper Q to which the toner image (not shown) has been fixed by the fixing device 130, that is, the paper Q on which the image corresponding to the image information from the document P has been formed, into an image output medium holding section (tray) 132.

The tray 132 is located in a space defined between the scanner 100 and the sheet cassette 124.

The cleaning mechanism 133 is located downstream of the transfer position and upstream of the discharge position in the direction in which the photosensitive drum 123 is rotated. The cleaning mechanism 133 removes a toner remaining without being transferred, from the surface of the photosensitive drum 123.

The image forming section 120 is provided with the charging device 121, the photosensitive drum 123, the developing device 124, and the cleaning mechanism 133 as a single unit (process unit).

When an instruction to read an image from the document P or to form an image is given, the scanner 100 outputs a first image signal based on the document P to the image processing section 111. The image processing section 111 outputs a second image signal to the exposure device 122. The exposure device 122 irradiates the photosensitive drum 123 with a laser beam to form an electrostatic image. The developing device 124 converts the electrostatic image into a toner image. The transfer device 129 transfers the toner image to the paper Q. The fixing device 130 fixes the toner to the paper Q, that is, forms the image from the document P on the paper Q.

First Embodiment

Figure 2:
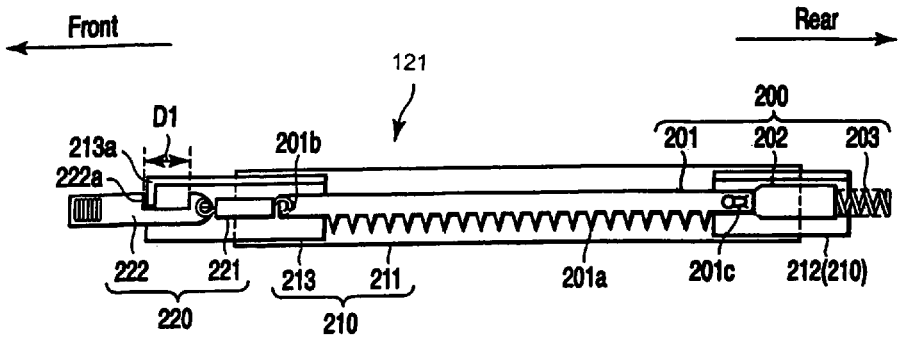
FIG. 2 is a schematic diagram of a charging device illustrating a first embodiment.

FIG. 2 is a schematic diagram showing an example of the charging device 121, shown in FIG. 1.

As shown in FIG. 2, the charging device 121 comprises a charger section 200, a charger case section 210, and an attachment removing mechanism 220. The charging device 121 is fixed to a process unit case (not shown) accommodating the process unit so that the rear of the image forming apparatus 1 lies on the right of the sheet showing FIG. 2, while its front lies on the left of the sheet. A closable door is provided in the front of the image forming apparatus 1. A user can perform predetermined operations through the door.

The charge section 200 includes a conductive member 201, a plate spring 202, and feeding section 203.

Figure 3:
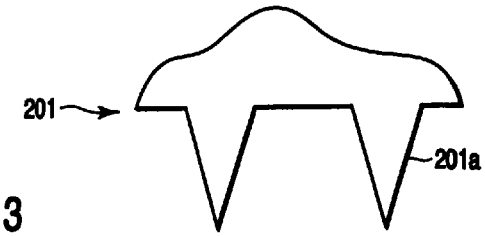
FIG. 3 is a schematic diagram showing a conductive member.

The conductive member 201 consists of stainless steel or the like having a predetermined length in the axial direction of the photosensitive drum 123. The conductive member 201 has a plurality of charging needles 201*a* such as those shown in FIG. 3; the charging needles 201*a* are provided on one side of the conductive member 201. Further, as shown in FIG. 2, a hole 201*b* supported by the attachment removing mechanism 220 is formed at the front end of the conductive member 201. A hole 201*c* to where the plate spring 202 is fixed is formed at the rear end.

The plate spring 202 is electrically connected to the hole 201*c* in the conductive member 201 at one end. The plate spring 202 is fixed to the feeding section 203 at the other end.

The feeding section 203 is fixed to, for example, a predetermined rear position of the process unit case (not shown). The feeding section 203 is electrically connected to a high-voltage generating mechanism 411 (see FIG. 8), described later.

The charger section 200 is fixed to the process unit case so that the axes of the conductive member 201 and photosensitive drum 123 are parallel to each other; this arrangement makes it possible to ensure a specified distance between the plurality of charging needles 201*a* and the photosensitive drum 123 in the axial direction.

The charger case section 210 includes a center case 211, a first terminal case 212, and a second terminal case 213.

The center case 211 consists of a heat insulating member, for example, metal and surrounds the conductive member 201 except for its surface through which the charging needles 201*a* lie opposite the photosensitive drum 123, the surface being closer to the bottom of the sheet of the drawing. This inhibits dust, paper dust, toner, and the like (attachment) form flowing through the main body from being electrostatically attracted to the conductive member 201, particularly its tip 201*d*.

The first and second terminal cases 212 and 213 consist of, for example, an insulating material such as resin. The first and second terminal cases 212 and 213 hold the center case 211 and are fixed in the apparatus, for example, to the process unit case.

The second terminal case 213 has a case hook portion 213*a* on its side opposite to that to which the center case 211 is fixed, that is, on its front.

The attachment removing mechanism 220 includes a tension spring 221 and a knob 222.

The tension spring 221 is an elastic member consisting of, for example, a spring which is formed by spirally winding an electric wire having a predetermined rigidity and which has key-like catching portions formed at its opposite ends. One end of the tension spring 221 engages with the hole 201*b* in the conductive member 201. The other end engages with the knob 222.

The knob 222 has a hook portion 222*a* engages with the case hook portion 213*a*. The knob 222 is located by the case hook portion 213*a* at a first position (fixture reference). The knob 222 thus maintains a tension applied by the tension spring 221 to the conductive member 201 at least a specified value, that is, so as to prevent the conductive member 201 from slackening. Further, the knob 222 is provided so as to be movable frontward at least from a first position to a second position, that is, a distance corresponding to a displacement D1.

The tension spring 221 applies at least a specified tension to the conductive member 201, which can thus maintain a rectilinear shape parallel to the axis of the photosensitive drum 123. However, of course, the conductive member 201 may further have a support member with a predetermined hardness, for example, at a position where the support member does not interfere with discharge from the charging needles 201*a*, for example, on the side closer to the top of the sheet of the drawing, which is opposite the side closer to the bottom of the sheet on which the charging needles 201*a* are formed.

Figure 4:
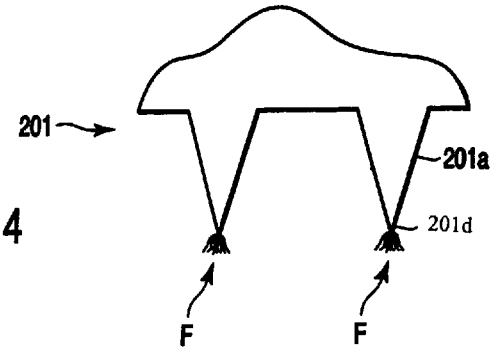
FIG. 4 is a schematic diagram showing attachments adhering to the conductive member.

When the image forming apparatus 1 is instructed to read or form an image, the feeding section 203 supplies predetermined power. The conductive member 201 starts discharging from the plurality of charging needles 201*a* (for example, corona discharge) to provide predetermined charge to the photosensitive drum 123. As more and more images are formed, dust, paper dust, toner, and the like (attachment F) drifting through the main body is electrostatically attracted to the tips 201*d* (at which discharge occurs) of the charging needles 201*a*. The attachment adheres to the tips 201*d* like fluff as shown in FIG. 4.

The attachment F is attached by a very weak force to the tips 201*d*. Accordingly, the attachment F is shaken off by a weak vibration or impact which is caused when, for example, the process unit is installed or removed.

The attachment F is preferably removed when a defective image is output because of a nonuniform discharge or the like, for example, when the user determines from the image formed that the attachment F adhering to the conductive member 201 must be removed.

Figure 5:
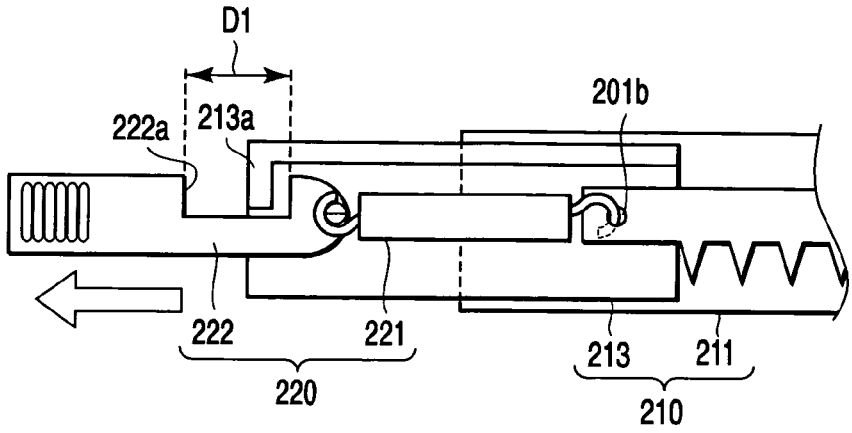
FIG. 5 is a schematic diagram illustrating an attachment removing mechanism shown in FIG. 2.
Figure 6:
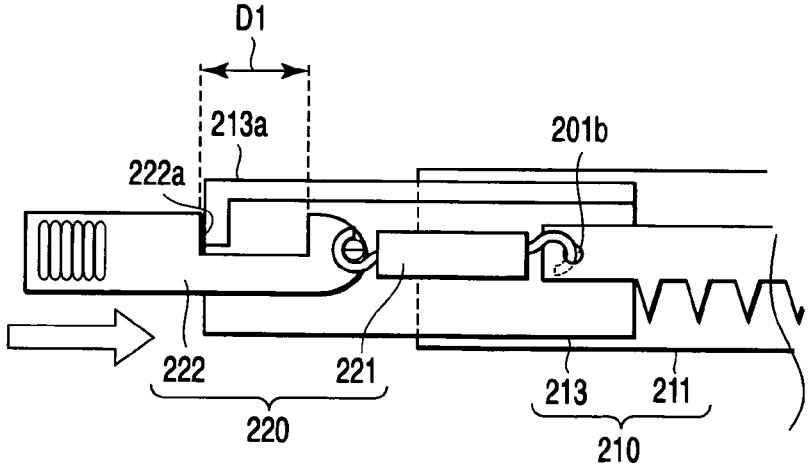
FIG. 6 is a schematic diagram illustrating the attachment removing mechanism shown in FIG. 2.

As shown in FIG. 5, the user pulls out the knob 222 frontward and then releases it. Then, the tension spring 221 exerts a force to return to the original position, that is, the first position. The knob 222 is thus returned to the first position as shown in FIG. 6.

At this time, the control hook portion 222*a* collides against the case hook portion 213*a* to vibrate the conductive member 201. Consequently, the attachment F adhering to the tips 201*d* of the conductive member 201 is shaken off.

Second Embodiment

Figure 7:
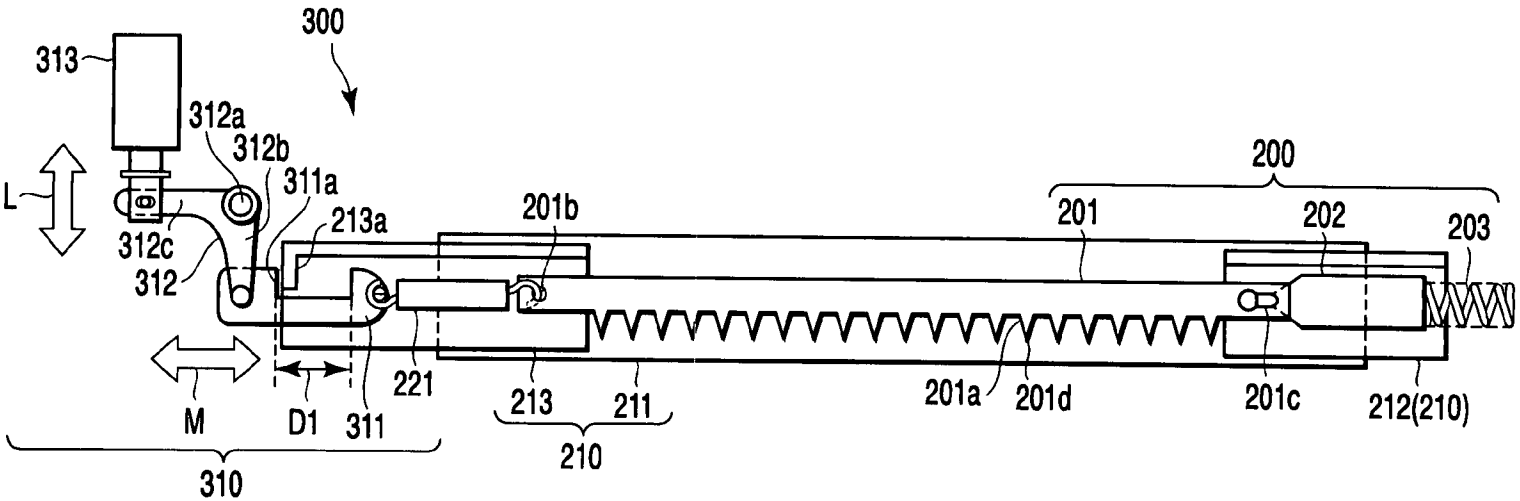
FIG. 7 is a schematic diagram of a charging device illustrating a second embodiment.

FIG. 7 is a schematic diagram showing a different example of the charging device 121, shown in FIG. 1.

As shown in FIG. 7, a charging device 300 comprises the charger section 200, the charger case section 210, and an attachment removing mechanism 310.

As described above, the charger section 200 includes the conductive member 201, the plate spring 202, and the feeding section 203. The charger case section 210 includes the center case 211, the first terminal case 212, and the second terminal case 213. Each of these components has a configuration similar to that in the description of FIG. 2. Accordingly, detailed descriptions are omitted.

The attachment removing mechanism 310 includes the tension spring 221, a control 311, an arm 312, and an arm power section 313.

As described above, one end of the tension spring 221 engages with the hole 201*b* in the conductive member 201. The other end engages with the control 311.

The control 311 has a control hook portion 311*a* engages with the case hook portion 213*a*. The control 311 engages with the case hook portion 213*a* to sit at the first position.

Then, the control 311 is moved frontward the distance corresponding to the displacement D1 to sit at the second position. In other words, the control 311 is provided so as to be movable from the first position to the second position.

The arm 312 includes a first arm member 312*b* rotated around a fulcrum 312*a* and a second arm member 312*c* formed at a predetermined angle to the first arm member 312*b* around the fulcrum 312*a*. The first arm member 312*b* is fixed to the control 311. The second arm member 312*c* is fixed to the arm power section 313.

The arm power section 313 is, for example, a solenoid, and when supplied with predetermined power, moves the fixed second arm member 312*c* in the vertical direction of the sheet of the drawings (the direction of arrow L), that is, the direction perpendicular to the axis of the photosensitive drum 123. Correspondingly, the first arm 312*b* swings clockwise to move the control 311 toward the left end of the sheet of the drawing.

Figure 8:
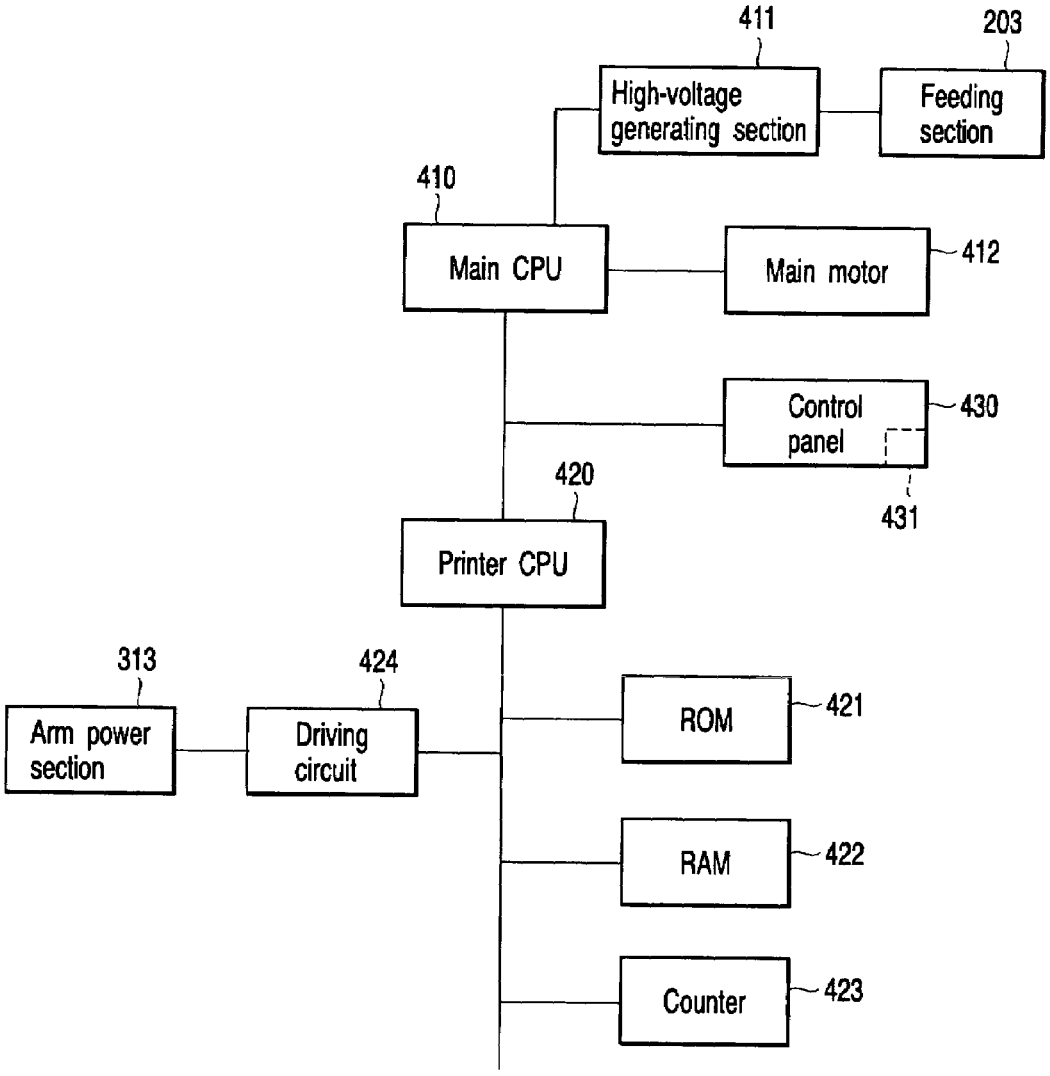
FIG. 8 is a block diagram showing how to control the charging device of the image forming apparatus according to the present invention.

FIG. 8 is a block diagram illustrating a control system that operates the image forming apparatus including the charging device 300, shown in FIG. 7.

As shown in FIG. 8, a main CPU 410 is connected to a printer CPU 420 and a control panel 430.

The main CPU 410 integrally controls the components of the image forming apparatus 1.

The printer CPU 420 integrally controls the components of the image forming section 120.

The control panel 430 comprises an operation section 431 to communicate an instruction from the user to the main CPU 410 or printer CPU 420.

When the user gives an instruction to form an image from the operation section 431, the printer CPU 420 outputs a charging signal to cause the plurality of charging needles 201*a* of the conductive member 201 to start discharging.

On receiving the charging signal input by the printer CPU 420, the main CPU 410 outputs a high-voltage generation signal.

Further, when an instruction to remove the attachment F is given, the printer CPU 420 outputs a drive signal at a predetermined time to drive a driving circuit 424.

The main CPU 410 is connected to the high-voltage generating mechanism 411 and a main motor 412.

The high-voltage generating mechanism 411 is connected to a power supply section (not shown) that supplies power required to operate the image forming apparatus 1. Predetermined power is thus supplied. On receiving the high-voltage generation signal input by the main CPU 410, the high-voltage generating mechanism 411 generates high-voltage power required to discharge electricity from the conductive member 201 in order to charge the photosensitive drum 123 to a predetermined potential. The high-voltage generating mechanism 411 supplies the power to the supply section 203, connected to the conductive member 201.

The main motor 412 operates the components of the scanner 100, image reading section 120, and the like, for example, the first and second carriages 105 and 107 or the photosensitive drum 123.

The printer CPU 420 is connected to a ROM 421, a RAM 422, a counter 423, and the driving circuit 424.

The ROM 421 stores a program that integrally controls the components of the image forming section 120 and exclusive programs that control discharge from the conductive member 201 or the arm power section.

The RAM 422 has, for example, a work area required by the printer CPU 420 to perform predetermined processing operations.

The counter 423 counts the number of output media (paper Q) on which images have been formed using the image forming section 120. The counter 423 reports the number to the printer CPU 420.

The driving circuit 424 receives the drive signal input by the printer CPU 420 to operate the connected arm power section 313.

Now, description will be given of a first method of shaking off attachment, that is, attachments adhering to the conductive member 201.

On receiving an instruction to form an image from the control panel 430, the printer CPU 420 outputs a charging signal. The charging signal causes the main CPU 410 to output a high-voltage generation signal. On receiving the high-voltage generation signal, the high-voltage generating mechanism 411 provides high-voltage power to the supply section 203. The supply section 203 transmits the high-voltage power to the conductive member 201. The conductive member 201 then provides a predetermined charge to the photosensitive drum 123.

As more and more images are formed, dust, paper dust, toner, or the like (attachment) drifting through the main body is electrostatically attracted to the tips 201*d* (at which discharge occurs) of the charging needles 201*a*. The attachment adheres to the tips 201*d* as contaminants. The attachment F or the like may then cause a nonuniform discharge. Thus, a defective image may be output.

Accordingly, for example, when the user determines that the attachment F must be removed because the defective image has been output and then gives, from the operation section 431, an instruction to remove the attachment, the printer CPU 420 outputs a drive signal to the driving circuit 424. The drive signal causes the driving circuit 424 to supply predetermined power to the solenoid 313, serving as the arm power section. That is, the solenoid 313 is energized. One end of the high-voltage generating mechanism moves in the direction of the arrow L, that is, in the direction orthogonal to the axis of the photosensitive drum 123. This converts the power of the solenoid 313 so that the power acts in the direction of an arrow M, that is, toward the photosensitive drum 123. As a result, the control 311 is pulled forward.

When the solenoid 313 is deenergized, the tension spring 221 attempts to return to its original position to return the control 311 to the first position as shown in FIG. 7.

Once the control 311 is returned to the first position, the control hook portion 311*a* collides against the case hook portion 213*a* to vibrate the conductive member 201. This vibration shakes off the attachment F adhering to the tips 201*d* of the conductive member 201.

The time for which the driving circuit 424 supplies power is counted by the counter 423 or may be such that the control 311 can apply vibration to the conductive member 201 which is sufficient to shake off the attachment F.

The arm power section is not limited to the solenoid 313 but has only to provide power to the control 311 in the direction of the arrow M.

Figure 9:
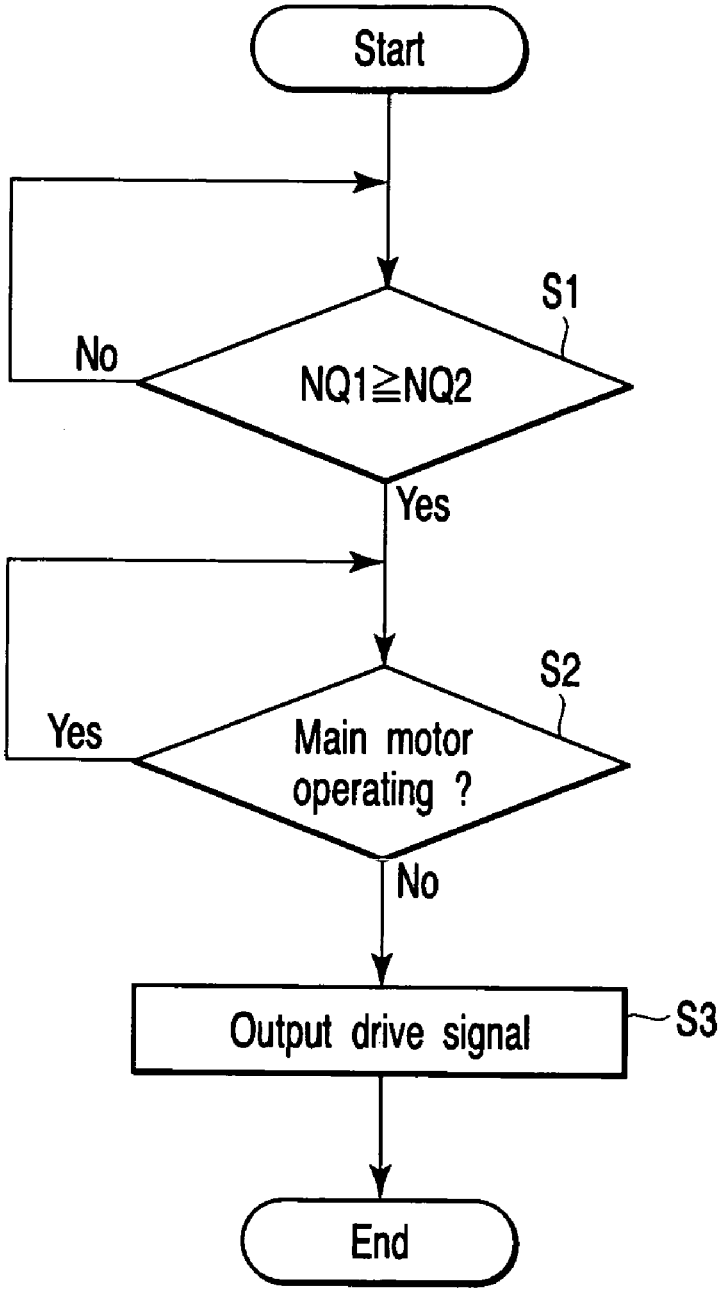
FIG. 9 is a flowchart illustrating an example of a method for operating the attachment removing mechanism.

Further, the method of outputting a drive signal is not limited to the above aspect but a second method, for example, one shown in FIG. 9, may be used.

FIG. 9 is a flowchart illustrating the second method of shaking off the attachment. In this case, the ROM 421 stores a program that allows the printer CPU 420 to output a drive signal if the number of output media NQ1 counted by the counter 423 reaches a prespecified value NQ2 (for example, 1,000) with which a defective image may be formed.

As shown in FIG. 9, the printer CPU 420 compares the number of output media NQ1 counted by the counter 423 with the print specified value NQ2 (S1).

If the number of output media NQ1 counted is at least 1,000 (S1-YES), the printer CPU 420 then monitors a motor drive signal for a motor driver circuit (not shown) to determine whether or not the main motor 412 is operating (S2). If the main motor 412 is not operating (S2-NO), the printer CPU 420 outputs a drive signal (S3).

When the drive signal is input to the driving circuit 424, the solenoid 313 is energized to cause vibration or an impact to shake off the attachment as described above.

While the main motor 412 is operating, one or both of the scanner 100 and image reading section 120 are operating. Accordingly, if the image forming section 120 is operating, that is, a toner image is being formed on the photosensitive drum 123, there is no possibility of the attachment F falling onto the surface of the photosensitive drum 123. If the scanner 100 is operating, there is no possibility of vibration generated by the arm power section 313 hinder a reading operation.

Third Embodiment

Figure 10:
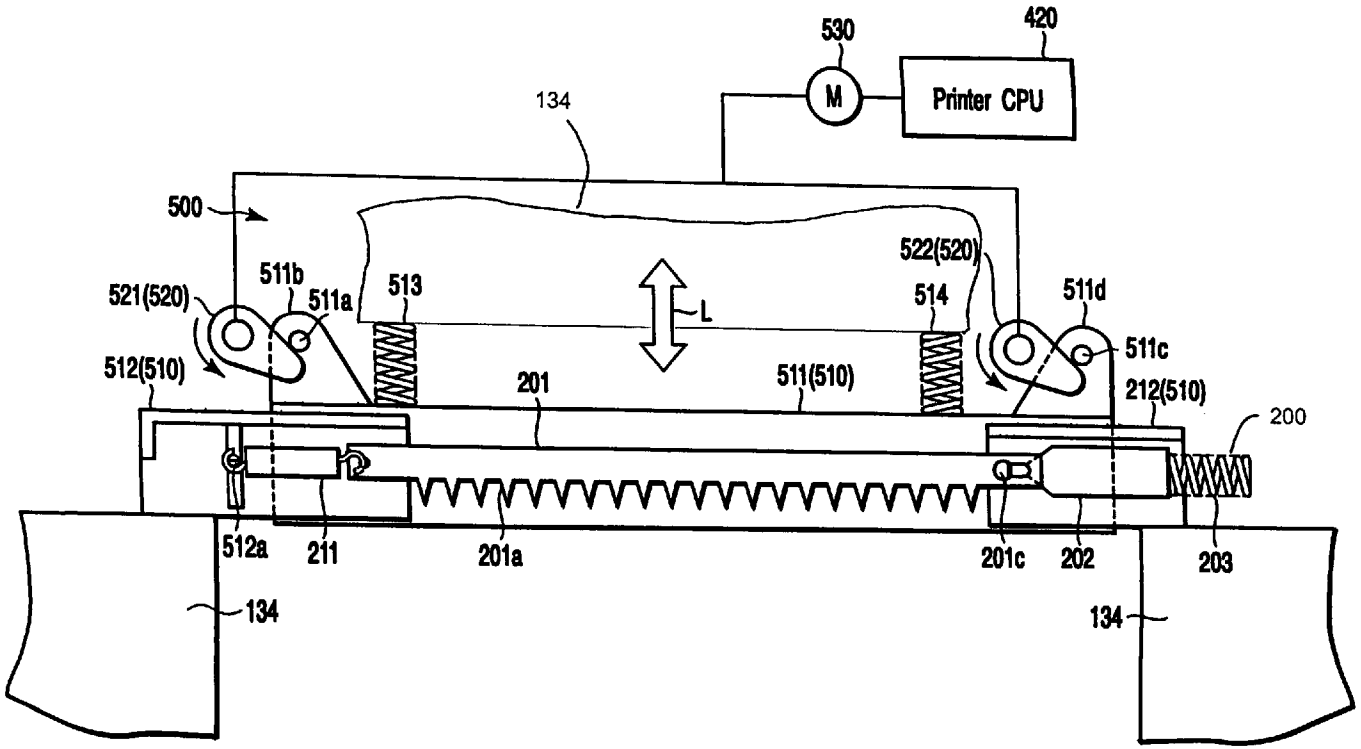
FIG. 10 is a schematic diagram illustrating a third embodiment.

FIG. 10 is a schematic diagram showing a further different example of the charging device 121, shown in FIG. 1.

As shown in FIG. 10, a charging device 500 comprises the charger section 200, a charger case section 510, and an attachment removing mechanism 520.

The charger section 200 includes the conductive member 201, the plate spring 202, and the feeding section 203. Each of these components has a configuration similar to that in the description of FIG. 2. Accordingly, their description is omitted.

The charger case section 510 includes a center case 511, the first terminal case 212, and a second terminal case 512.

The center case 511 consists of a heat-insulating member, for example, metal, and surrounds the conductive member 201 except for its surface through which the charging needles 201*a* lie opposite the photosensitive drum 123, the surface being closer to the bottom of the sheet of the drawing. A pin portion 511*b* having a pin 511*a* is formed at one end of a top surface portion of the center case 511, that is, the portion of the center case 511 located opposite the photosensitive drum 123. A pin portion 511*d* having a pin 511*c* is formed at the other end.

The first and second terminal cases 212 and 512 consist of, for example, an insulating material such as resin. The second terminal case 512 has a terminal hook 512*a* at a predetermined position on which the tension spring 221 can be engage.

One of compression springs 513 and 514 is fixed to the process unit case 134, while the other compression spring 514 and 513 is fixed to the center case 511. These springs exert a predetermined pressure on the first and second terminal cases 212 and 512 toward the bottom of the sheet of the drawing, that is, toward the photosensitive drum 123. The process unit case 134 supports the first and second terminal cases 212 and 512, on which the predetermined pressure is exerted, in places where the first and second terminal cases 212 and 512 do not interfere with charging of the photosensitive drum 123.

The attachment removing mechanism 520 includes a first cam 521 and a second cam 522.

The first and second cams 521 and 522 are fixed to a rotating shaft on which, for example, a motor 530 connected to the printer CPU 420 exerts a rotating force acting in counterclockwise direction of the sheet of the drawing. Each of the first and second cams 521 and 522 is shaped like, for example, an oval having a part with a long distance from the rotating shaft and a part with a shorter distance from the rotating shaft.

On receiving a drive signal input by the printer CPU 420, the motor 530 rotates the rotating shaft a predetermined number of times (for example, once).

Description will be given of an operation of shaking off attachment, that is, attachments adhering to the conductive member 201, by applying the first method based on the instruction from the control panel 430 as described above.

For example, when the user determines that the attachment must be removed because a defective image has been output and then gives, from the operation section 431, an instruction to remove the attachment, the printer CPU 420 outputs a drive signal to the motor 530. Then, the motor 530 rotates the rotating shafts.

The first and second cams 521 and 522 rotate around the respective rotating shafts and reach respective predetermined positions. Then, the first and second cams 521 and 522 abut against the respective pins 511*a* and 511*c* to lift the charger sections 200 and 510 via the pins 511*a* and 511*c*, respectively, in the upward direction of the sheet of the drawing. A further rotation of the rotating shafts causes the first and second cams 521 and 522 to leave the pins 511*a* and 511*b*, respectively. The compression springs 513 and 514 then serve to locate the charger case section 510 at its original position, that is, the position where it is supported by the process unit case 134. The charger case section 510 then collides against the process unit case 134. This causes the conductive member 201 to vibrate to shake off the attachment, that is, the attachments adhering to the conductive member 201.

As shown in the flow-chart in FIG. 9, if the number of output media NQ1 has reached the specified value NQ2, which is fixed, and the main motor 412 is not operating, then the printer CPU 420 outputs a drive signal.

When the drive signal is input to the motor 530, the first and second cams 521 and 522 rotate to generate vibration or an impact, thus shaking off the attachment adhering to the tips 201*d* of the conductive member 201 as described above.

Fourth Embodiment

Figure 11:
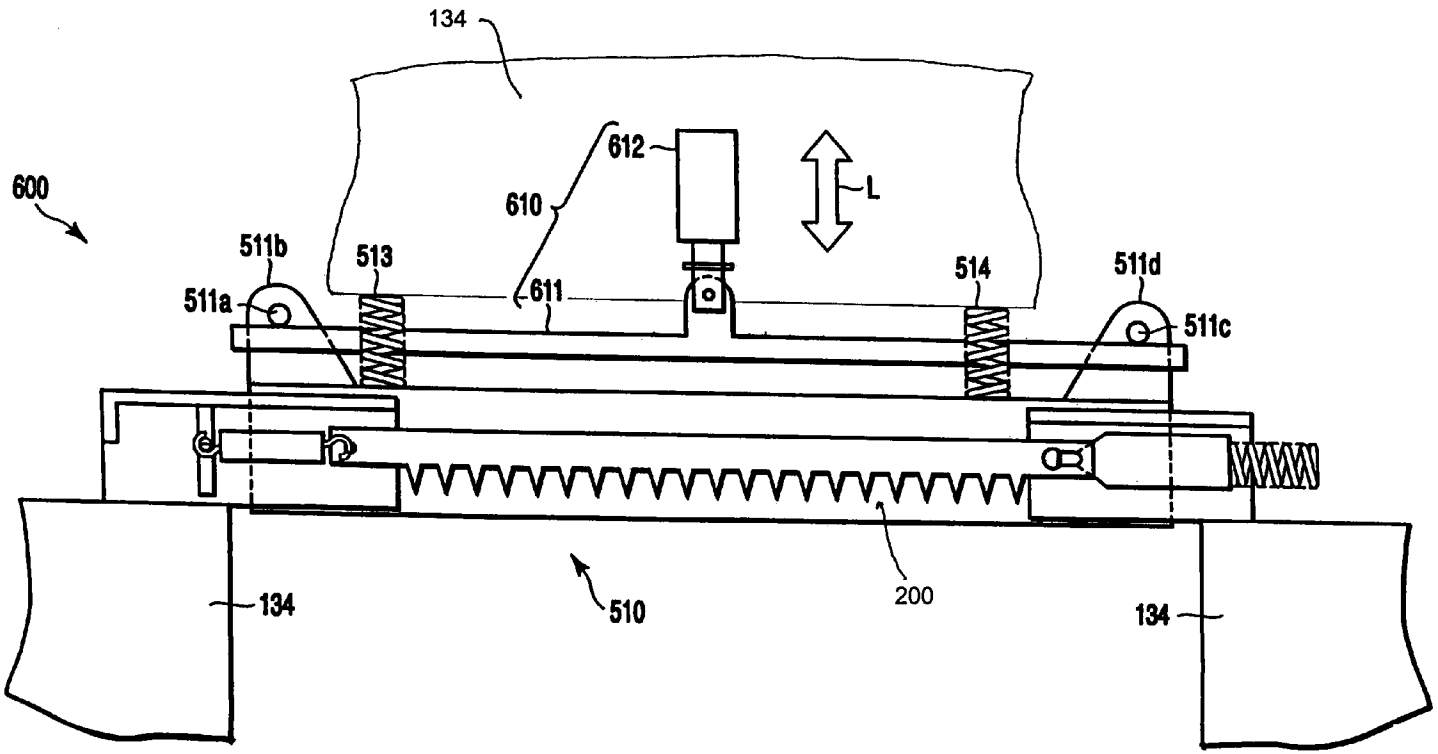
FIG. 11 is a schematic diagram illustrating a fourth embodiment.

FIG. 11 shows an example of an attachment removing mechanism different from that according to the third embodiment shown in FIG. 10.

As shown in FIG. 11, a charging device 600 comprises the charger section 200, the charger case section 510, and an attachment removing mechanism 610.

The attachment removing mechanism 610 comprises an arm 611 and an arm power section 612.

The arm 611 has a predetermined distance sufficient to reach the pins 511*a* and 511*c* and is fixed to the arm power section 612 at its center.

The arm power section 612 is, for example, a solenoid, and when supplied with predetermined power, moves the arm 611 in the vertical direction of the sheet of the drawings (the direction of arrow L), that is, the direction perpendicular to the axis of the photosensitive drum 123.

As in the case of the second embodiment, the arm power section 612 is connected to the driving circuit 424. When the printer CPU 420 inputs a drive signal to the driving circuit 424, the arm power section 612 is supplied with predetermined power and is turned on.

Description will be given of an operation of shaking off attachment, that is, attachments adhering to the conductive member 201, using the first method based on the instruction from the control panel 430 as described above.

For example, when the user determines that the attachment must be removed because a defective image has been output and then gives, from the operation section 431, an instruction to remove the attachment, the printer CPU 420 outputs a drive signal to the driving circuit 424.

Then, the solenoid 612 is energized to lift the arm 611 in the upward direction of the sheet of the drawing. The pins 511*a* and 511*c* are caught on the arm 611 to lift the charger case section 510 upward.

Deenergizing the solenoid 612 causes the compression springs 513 and 514 to push the charger case section 510 downward. The charger case section 510 is then located at a predetermined position where it is supported by the process unit case 134. The charger case section 510 thus collides against the process unit case 134. This causes the conductive member 201 to vibrate to shake off the attachment F adhering to the tips 201*d* of the conductive member.

Description will be given of an operation of shaking off attachment, that is, attachments adhering to the conductive member 201, by applying the second method based on the instruction from the counter 423 as described above.

As shown in the flowchart in FIG. 9, if the number of output media NQ1 has reached the specified value NQ2, which is fixed, and the main motor 412 is not operating, then the printer CPU 420 outputs a drive signal.

When the drive signal is input to the driving circuit 424, the solenoid is energized and deenergized to generate vibration or an impact, thus shaking off the attachment F adhering to the tips 201*d* of the conductive member, as described above.

What is claimed is:

1. An image forming apparatus comprising:

a charging member including a conductive member having a plurality of projecting portions formed along an axial direction of an image carrier so that a discharge occurs on the plurality of projecting portions to provide a predetermined potential to the image carrier;

a plate member electrically connected to one end of the charging member and fixed at a predetermined position;

an elastic member connected to the other end of the charging member to hold the charging member using a predetermined tension; and a pullout member connected to the elastic member and provided so as to be movable between a first position and a second position;

wherein the elastic member is displaced as the pullout member moves, to vibrate or impact the charging member utilizing a force exerted to return to the first position.

2. The image forming apparatus according to claim 1, wherein the pullout member is connected to a power mechanism which provides the pullout member with power required for the movement.

3. The image forming apparatus according to claim 2, wherein the power mechanism comprises a motor.

4. The image forming apparatus according to claim 2, wherein the power mechanism comprises a solenoid.

5. The image forming apparatus according to claim 2, wherein the power mechanism is accessed by operating a control panel.

6. An image forming apparatus comprising:

a charging mechanism which includes an electrode to provide a predetermined potential for an image carrier;

an elastic member which holds the electrode at a predetermined position using a predetermined tension;

an attachment removing mechanism which generates vibration or impact utilizing a force of the electrode undergoing a predetermined displacement and returns to an original position, the attachment removing mechanism shaking off attachments electrostatically adhering to the electrode;

counting means for counting the number of output media on which images have been formed;

control means for operating the attachment removing mechanism if the number of output media counted by the counting means reaches a prestored specified value;

a plate member electrically connected to one end of the charging mechanism and fixed at a predetermined position; and a pullout member connected to the elastic mechanism connected to the other end of the electrode, and provided so as to be movable between a first position and a second position, wherein the elastic member is displaced as the pullout member moves, to vibrate or impact the electrode utilizing a force exerted to return to the first position.

7. The image forming apparatus according to claim 6, further comprising:

a case which supports the charging mechanism placed at the original position by the tension of the elastic member, wherein the elastic member includes compression springs.

8. The image forming apparatus according to claim 6, wherein the electrode has a plurality of projecting portions formed along an axial direction of the image carrier so that the projecting portions are discharged to provide the predetermined potential for the image carrier.

* * * * *